United States Patent [19]

Cooke

[11] Patent Number: 4,627,547

[45] Date of Patent: Dec. 9, 1986

[54] CHILD RESISTANT PACKAGE

[76] Inventor: Carl W. Cooke, 5106 Perry Park Rd., Sedalia, Colo. 80135

[21] Appl. No.: 816,009

[22] Filed: Jan. 3, 1986

[51] Int. Cl.[4] ..... B65D 55/02

[52] U.S. Cl. ..... 215/222

[58] Field of Search ..... 215/222, 330, 332

[56] References Cited

U.S. PATENT DOCUMENTS 4,526,281 7/1985 Herr ..... 215/222

4,567,992 2/1986 Davis ..... 215/222

*Primary Examiner*—George T. Hall

*Attorney, Agent, or Firm*—John E. Vanderburgh

[57] ABSTRACT

An improved child resistant package comprising a container and closure and resilient means for normally urging the closure axially away from the container when the container is sealed by the closure. Cooperating sets of locking elements rim the container adjacent its mouth and are disposed about the inner surface of the depending skirt portion of the container for locking and maintaining the closure in a sealed position over the mouth of the container. One set of the locking elements comprise pairs of spaced apart projections which define a through-running channel therebetween. The other set of locking elements comprise corresponding latch members, each of which defines a stop element which is received in through-running channels and a retaining portion which acts against one of the paired projections to retain the closure from axial movement in opposition to the urging of the resilient member. In the event of the shearing of portions of the projections, the locking feature of the closure is retained by virtue of the through-running channel which permits the latch member to be positioned toward the container mouth with the surface of the stop element in contiguity with undamaged portions of the projections.

7 Claims, 6 Drawing Figures

CHILD RESISTANT PACKAGE

FIELD OF THE INVENTION

This invention relates to the field of child resistant packaging of the type where the closure is removed from the container by special manipulation, thereby rendering its removal without such manipulation extremely difficult.

BACKGROUND OF THE INVENTION

Over the past years there has been increasing interest in the design and development of packaging of the type so called "child resistant," that is to say, packaging designed so that it cannot be opened accidentally or intentionally by children without special manipulation of the closure. Such packaging has found use for pharmaceuticals and harmful compositions which are used in the home with which children are likely to come into contact. This interest has led to the development of standards and testing procedures by various governmental and international agencies.

Numerous designs for such packaging are available and they can be said generally to fall into two major categories: packaging having closures of multi-component design, and packaging having closures in which the locking elements are integrally formed as part of the closure. Single component closures are normally designed to be removed by manipulating the closure in a manner that is difficult for children. Single component closures are preferred, since they can be more easily and economically manufactured using mass production methods. Examples of such child resistant packaging utilizing single component closures are to be found in my U.S. Pat. Nos. 3,952,899, 4,139,112 and 4,434,903. Examples of other single piece closures are found in U.S. Pat. No. Re. 27,156 (Hedgewick), U.S. Pat. No. 3,880,314 (Ackers), U.S. Pat. No. 3,779,001 (Bogert), U.S. Pat. No. 4,032,028 (Reiss et al.) and U.S. Pat. No. 4,119,232 (Thornton).

In packaging of the type to which this invention relates, there is a high probability that the closure will be removed forcibly without proper manipulation which will result in damage to the locking elements rendering the package inoperable with respect to the locking feature. In this regard many specifications for child resistant packages call for testing of the package to determine its ability to withstand the forced removal of the closure and its ability to retain the locking feature even after such forced removal.

SUMMARY OF THE INVENTION

The present invention relates to an improved child resistant package which is provided with locking means making it resistant to being opened without special manipulation when in the sealed mode and which will retain its child resistant characteristic after the locking means are partially damaged such as by forced removal of the closure without proper manipulation.

In accordance with the present invention, there is provided a container having a set of locking elements adjacent the mouth portion and a closure including a depending skirt portion carrying a corresponding set of locking elements which cooperate with the locking elements of the container to provide a positive lock of the closure on the container when the closure is in a sealing position over the mouth of the container. The inner face of the closure is provided with resilient means to urge the closure axially upwardly to maintain the locking elements in the locked position when the closure is sealingly engaged over the mouth of the container. In this manner the closure is resistant to removal from the container by mere turning unless one applies an axially downward force on the closure to disengage the respective locking elements coupled with a turning motion to permit removal of the closure.

One set of locking elements comprises pairs of spaced apart projections defining therebetween a through-running channel. The other set of locking elements comprises latch members. Each latch member defines a stop element adapted to be received in the through-running channel between the pairs of projections. The projections serve as a positive stop for the latch member. The latch member further includes a retaining portion which engages the lower face of one of the pairs of projections to maintain the closure over the mouth of the container in opposition to the urging of the resilient member. As thus positioned, the closure is locked on the container and normally removed only by the manipulation described above.

The forced removal of the closure will normally result in a shearing away or eroding of a portion of the projection providing the positive stop for the latch member. In accordance with the present invention the locking elements are designed so that by provision of the through-running channel a corresponding latch member will be free to locate toward the mouth of the container with the stop element and retaining portion in contiguity with undamaged or less damaged portions of the projections, thus retaining the locking feature when the closure is replaced on the container after forced removal of the closure.

In accordance with the invention, one projection of each pair, normally the projection disposed on the clockwise side of each pair, is elongated sufficiently to engage and stop the corresponding latch member of the closure to indicate alignment of the stop element with the through-running channel and to prevent removal of the closure by turning it in the clockwise direction.

In an embodiment of the invention, the lower surface of the projection disposed on the counter-clockwise side of each pair is disposed in an angular plane with respect to the axis of the package to define a camming surface to urge the closure downward over the container mouth in response to turning the closure in a clockwise direction. Preferably the face of the retaining portion of the latch member is disposed in a corresponding angular plane so that the two forces are contiguous when the closure is in the locked and sealed position of the container to prevent rocking of the closure and to maintain even sealing pressure around the rim portion of the container.

Also, it is preferred that the spacing between each of the paired projections be such that the width of the through-running channel defined therebetween and the width of the stop element of the latch member be substantially equal, that is to say, the respective dimensions are such that the stop element will be freely received in the channel with a minimum of play to provide a tight lock for the closure.

Other aspects and advantages of the present invention will become apparent from the following detailed description taken in conjunction with the accompanying drawings.

DETAILED DESCRIPTION OF THE INVENTION

Figure 1:
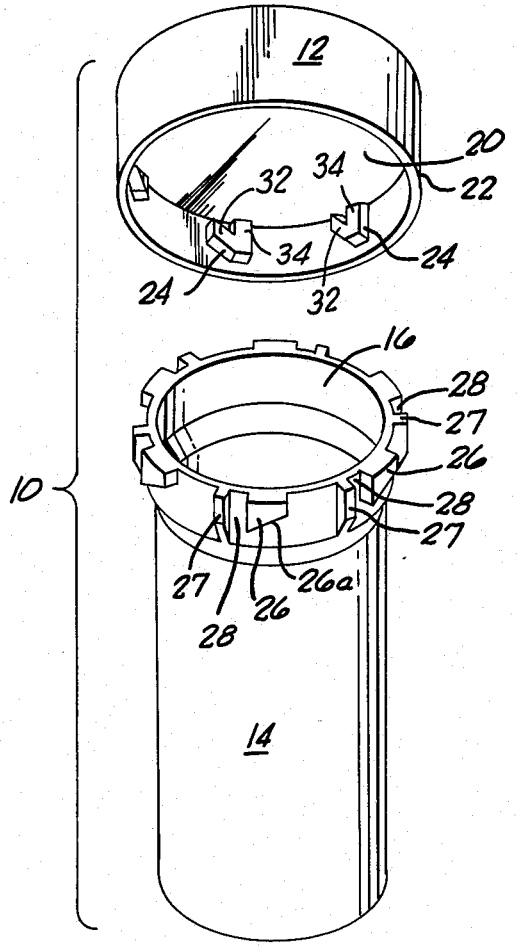
FIG. 1 is an isometric view of the closure and container showing a portion of the interior of the closure and the container and illustrating the locking elements formed on the closure and the container.

Referring to the drawings and particularly to FIG. 1, there is shown a package 10 comprising a closure 12 and a container 14 having an open mouth 16. The package 10 is of the type commonly used in packaging pharmaceutical products, although the invention is not so limited and may be utilized for the packaging of any products where it is desired that the closure be locked on the container. The closure 12 has a top wall 18 which carries a resilient sealing member of any type well known in the art such as, for example, a resilient cylindrical member adapted to be received in the mouth 16 of the container 14 or, as illustrated, an elastomeric liner 20. The closure 12 further includes a cylindrical depending skirt 22 having latch members 24 formed on the inner surface thereof, the configuration and purpose of which will be more fully described. The container includes projections 26 and 27 which are arranged about the rim of the container adjacent the open mouth 12 in spaced apart pairs to define a through-running channel 28 between each pair of the projections.

The closure 12 and container 14 are preferably molded from a moisture-resistant material such as polyethylene or polypropylene and the latch members 24 and projections 26 and 27 are preferably integrally formed on the closure and container respectively as part of the molding operation. The resilient member may be integrally formed as part of the closure 12 to provide what is commonly described as a "single-piece cap" or, as illustrated, may be a separate liner 20 formed of a resilient compressible material such as foamed polyurethane or neoprene rubber or the like over which may be laid a flexible, fluid impervious outer layer so that the liner is adapted to fit around the rim of the container 14 to form a fluid tight seal therewith when the closure is drawn down over the mouth 16 of the container. In addition, the resilient action may be accomplished by inwardly biasing the other surface of the container 14 adjacent the mouth 16 to provide a resilient rim which cooperates with a correspondingly biased ring member disposed in the skirt 22 of the closure 12 adjacent the top wall 18. When sealed, the resilient rim is received in the ring member of the closure and is compressed inwardly by the ring member to provide the required resiliency to urge the closure 12 axially upwardly and to provide a fluid tight seal of the container 14.

In accordance with the invention, each latch member 24 defines a retaining portion 32 and a stop element 34 which extends beyond the retaining element. The lower surface of each of the projections 26 is preferably disposed in an angular plane with respect to the axis of the container 14 to define a camming surface **26*a*. Each projection 27 is preferably axially extended with respect to the projections 26 and the spacing between each pair of the projections 26 and 27 is selected such that the throughrunning channel 28 is slightly wider than the stop element 34**.

Figure 2:
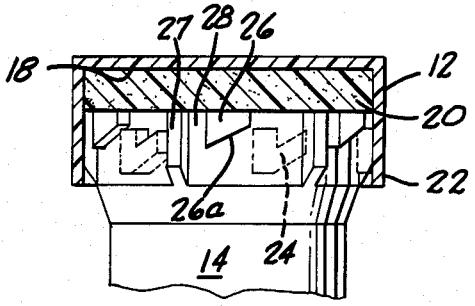
FIG. 2 is a side view in enlarged scale partially in section and partially broken away for compactness of illustration showing the closure over the mouth of the container prior to moving the closure into a sealing, locked position.
Figure 3:
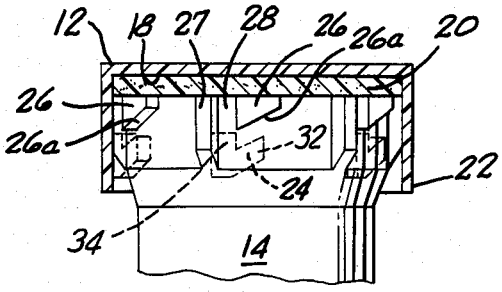
FIG. 3 is a side view in enlarged scale partially in section and partially broken away for compactness of illustration showing the closure in a fully downward position over the mouth of the container with the stop elements of the closure latches aligned with the through-running channels of the container.
Figure 4:
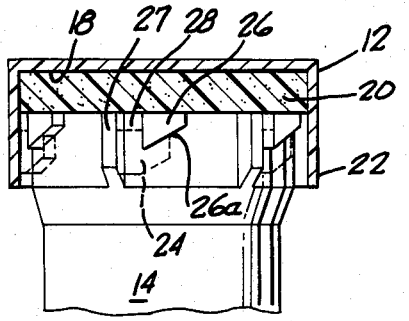
FIG. 4 is a side view in enlarged scale partially in section and partially broken away for compactness of illustration showing the closure in the locked, sealing position on the container.

Referring to FIGS. 2–4 the closure 12 is placed over the mouth 16 of the container 14 and as is illustrated, each of the pairs of projections 26 and 27 are sufficiently separated to permit the latch members 24 to freely pass so that the elastomeric liner 20 contacts the rim of the container (FIG. 2). As the closure 12 is twisted in a clockwise direction, each of the latch members 24 contacts the camming surface **26*a* of a corresponding projection 26 on the counter-clockwise side of each pair to draw the closure axially downwardly over the container mouth 16 and compressing the elastomeric liner 16. The stop element 34 is brought into alignment with the through-running channel 28 (FIG. 3). Responsive to the upward urging of the compressed liner 22, the stop element is moved into the through-running channel to lock the closure 12 on the container 14 and the retaining portion 32 contacts the projection 26 to hold the closure 12 in sealed position against the urging of the compressed elastomeric liner 20 (FIG. 4). The elongated projection 27 prevents further turning of the closure 12 in a clockwise direction even if sufficient downward force is applied to the closure to prevent the stop element 34 from moving into the through-running channel 28. This provides a positive indication of the alignment of the stop element with the throughrunning channel and prevents removal of the closure by continued rotation in the clockwise direction. As mentioned, the channel 28 is preferably dimensioned to be slightly larger than the stop element 34 so that there is maintained a minimum of play between the closure 12 and the container 14** to provide a tight lock between the closure and the container.

The closure 12 is removed by applying sufficient force on the closure to move the stop element 34 out of the channel 28 while twisting the closure in the counter-clockwise direction. This manipulation is normally beyond the capabilities of most young children, thus rendering the package child resistant.

Figure 6:
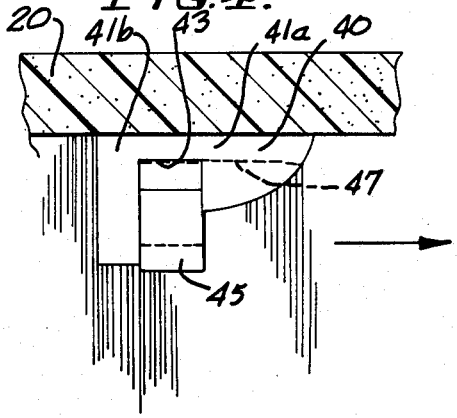
FIG. 6. PRIOR ART
FIG. 6 is a view corresponding to that of FIG. 5 but showing a set of locking elements designed in accordance with the prior art and showing by dotten lines typical damage caused by the forced removal of the closure.

However, as with any child resistant package, there is the possibility that through carelessness or otherwise, the package may be forcibly opened without proper manipulation by application of sufficient force to overcome the shear strength of the locking elements, resulting in the shearing of the locking elements which may render the package inoperable as a child resistant package. Normally with locking elements of the general type described herein, that is, where the design of one of the elements is of the bayonet or hook lug configuration, the bayonet or hook lug will shear in preference to the corresponding element with which it cooperates to provide the locking action. Referring to FIG. 6 wherein like number indicates like parts already described, there is illustrated a portion of a container and a closure which is provided with a resilient member such as the elastomeric liner 20 which functions in the manner already described. The locking elements comprise a unitary bayonet type lug 40 of prior art design. The bayonet lug 40 includes a first portion 41*a* and a second portion 41*b* which are spaced apart to define a notch 43 therebetween. A corresponding lug 45, which is normally disposed on the closure member, is received in the notch 43 to lock the elements and the bed of the notch retains the lug against the urging of the resilient member 20 of the closure.

Forced removal of the closure produces a shearing of the first portion 41*a* of the bayonet lug as indicated by dotted line 47. As will be apparent, any shearing away of the first portion 41*a* substantially reduces the locking effect of the bayonet lug 41 and as illustrated, the locking action is essentially eliminated, since there is no surface for the lug 45 to act against to resist counter rotation of the closure.

Figure 5:
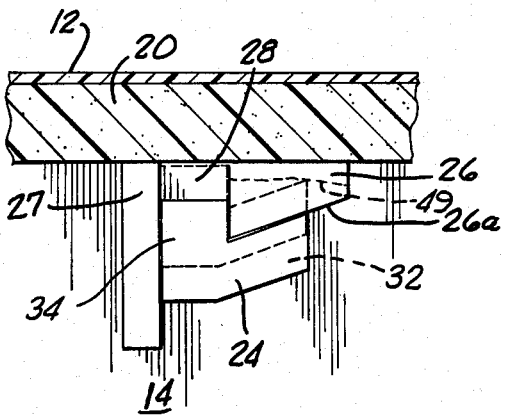
FIG. 5 is a fragmentary, transverse, vertical section, drawn in enlarged scale, of a portion of a container and closure showing one set of locking elements of the present invention in the locked and sealed position and showing by dotted lines typical damage caused by the forced removal of the closure and the repositioning of the latch member after such damage.

Referring to FIG. 5, which illustrates locking elements in accordance with the present invention and like numbers designate like parts already described, there is shown by dotted line 49 that portion of projection 26 remaining after shearing due to the forced removal of the closure. As shown, when the closure 12 is replaced on the container 14, the stop element 34 is permitted to move up further in the through-running channel 28 to engage the remaining undamaged portion of the projection 26 to provide the locking action, even though a substantial portion of the projection has been sheared away.

It should be understood that for purposes of illustration, the shearing action resulting from the forced removal of a closure has been shown as a worst case, but it should be clear that any reduction in the contact surface area between the corresponding locking elements reduces the locking effect of the elements and renders the package easier to open without manipulation and therefore less child resistant. It accordance with the invention, the locking elements are able to be adjusted to compensate for the effects of forced removal of the closure retaining as much as possible the child resistant features of the package, even after misuse.

Although not preferred, it will be apparent that the placement of the locking elements may be reversed and that the latch member 24 may be placed on the container 14 and the projections 26 and 27 placed on the closure 12.

While a preferred embodiment and modifications of the invention have been described in the foregoing description and illustrated in the drawings, it will be understood that minor changes may be made in the details of construction as well as in the combination and arrangement of parts without departing from the spirit and scope of the invention as claimed.

What is claimed is:

1. A child resistant package comprising an open-mouthed container and a closure therefor including a top wall and depending skirt portion for receiving and sealing the mouth of said container, resilient means to urge said closure axially away from said container as said closure is drawn into the sealing position over the mouth of said container and cooperating sets of locking elements disposed on the inner surface of the depending skirt portion of said closure and rimming the open mouth of said container, the invention comprising:

one set of said locking elements comprising latch members defining a retaining portion and a stop element and said other set comprising pairs of spaced apart projections defining an openended, through-running channel therebetween for receiving the stop element of a corresponding latch member, the projections providing a positive stop for the stop element to prevent removal of said closure by mere turning, one of the projections engaging the retaining portion of the corresponding latch member to retain said closure in opposition to the urging of the resilient member, there being required the combination of an axially downward force on and a turning of said closure with respect to said container to remove said closure from the sealed and locked position on said container, and in the event said projections are damaged by shearing due to forced removal of the closure and the like, the through-running channels permitting the latch members to be positioned in the channel toward the mouth of said container with the stop element thereof of contiguity with undamaged portions of the projections to retain the locking action between the cooperating sets of locking elements.

2. The package of claim 1 wherein one of the projections of each of the pairs of projections is extended with respect to the other projection of each of the pairs of projections.

3. The package of claim 1 wherein the lower surface of one of the projections of each of the pairs of projections is disposed in an angular plane with respect to the axis of said container to define a camming surface for a corresponding latch member of said closure to draw said closure axially over the mouth of said container responsive to the turning of said closure.

4. The package of claim 1 wherein the upper surface of the retainer portion of the latch member is disposed in an angular plane of the projection camming surface.

5. The package of claim 1 wherein a plurality of latch members are disposed about the inner surface of the depending skirt portion of said closure and corresponding parts of the projections are disposed about said container adjacent the mouth thereof.

6. The package of claim 1 wherein a plurality of spaced apart pairs of projections are disposed about the inner surface of the depending skirt portion of said closure and corresponding latch members are disposed about said container adjacent the mouth thereof.

7. The package of claim 1 wherein said corresponding sets of locking elements are integrally formed on said container and said closure.

* * * * *